US006065312A

United States Patent [19]

Sumner et al.

[11] Patent Number: 6,065,312

[45] Date of Patent: May 23, 2000

[54] WASHING MACHINE

[75] Inventors: Barry David Sumner, Bexhill-On-Sea; Martin William Myerscough, London, both of United Kingdom

[73] Assignee: Monotub Industries plc, United Kingdom

[21] Appl. No.: 09/306,479

[22] Filed: May 6, 1999

Related U.S. Application Data

[63] Continuation of application No. PCT/GB97/03079, Nov. 7, 1997.

[51] Int. Cl.[7] ..... D06F 21/10; D06F 39/08

[52] U.S. Cl. ..... 68/208

[58] Field of Search ..... 68/23.4, 58, 208

[56] References Cited

U.S. PATENT DOCUMENTS

| | | | |
|---|---|---|---|
| 801,627 | 10/1905 | Wunsch | 68/208 X |
| 2,391,634 | 12/1945 | Lewis et al. | 68/208 X |
| 2,538,200 | 1/1951 | Johnston | 68/208 |
| 2,539,533 | 1/1951 | Douglas | 68/208 X |
| 2,561,186 | 7/1951 | Dunham | 68/208 X |
| 2,615,320 | 10/1952 | Belaieff | 68/208 X |
| 2,637,186 | 5/1953 | Douglas | 68/23.4 |
| 2,637,189 | 5/1953 | Douglas | 68/208 X |
| 2,667,777 | 2/1954 | Kling et al. . | |
| 2,784,500 | 3/1957 | Beaumont . | |
| 2,817,501 | 12/1957 | Schubert . | |
| 2,895,320 | 7/1959 | Long | 68/208 X |
| 3,803,882 | 4/1974 | Brennan | 68/208 |
| 4,941,333 | 7/1990 | Blessing | 68/208 X |

FOREIGN PATENT DOCUMENTS

| | | | |
|---|---|---|---|
| 1075624 | 4/1954 | France | 68/208 |
| 1472650 | 3/1966 | France . | |
| 1017128 | 10/1957 | Germany | 68/58 |
| 42 02 760 A1 | 8/1993 | Germany . | |
| 119892 | 11/1958 | New Zealand . | |
| 156403 | 8/1971 | New Zealand . | |
| 782145 | 9/1957 | United Kingdom . | |

*Primary Examiner*—Philip R. Coe
*Attorney, Agent, or Firm*—Fredrikson & Byron, PA

[57] ABSTRACT

A washing machine having a generally cylindrical drum having a substantially closed back face, a front opening, and an axis inclined to the horizontal about which the drum is rotatable. The drum includes a plurality of outlets provided on the back face of the drum generally around the outer circumference of the back face. At least one of the outlets is below the height of the front opening for any angular position of the drum.

12 Claims, 6 Drawing Sheets

WASHING MACHINE

RELATED APPLICATIONS

This is a continuation of International Application No. PCT/GB97/03079 filed Nov. 7, 1997, which claims priority to British application No. 9713935.6 filed Jul. 1, 1997 and British application No. 9623443.0 filed Nov. 8, 1996.

BACKGROUND OF THE INVENTION

Conventional drum type automatic washing machines include a perforated cylindrical drum mounted for rotation about a horizontal axis within a fixed, closed water tank. Garments or other items to be washed are placed in the rotatable cylindrical drum, typically through a front opening door to the drum, or alternatively through an opening in the side wall of the drum. In either case, the opening of the drum is closed, and the water tank closed.

Water is introduced into the water tank, filling the tank to a predetermined level. The water may be heated either before filling the tank, within the tank by a heater or may be removed from the water tank and heated before being reintroduced into the tank. The water within the water tank enters the cylindrical drum through the perforations in the cylindrical drum or through the shaft. The cylindircal drum is then rotated about its axis to agitate the items to be washed and to pass these through the washing water.

After completion of the washing cycle, the washing water is removed from the water tank, and hence from the cylindrical drum via an outlet. The outlet is typically in the form of a valve which allows water to drain from the water tank by gravity, or is a pump. Clean water for rinsing is then introduced to the water tank and hence into the cylindrical drum. The drum is again rotated to agitate the items within the drum. The rinsing water is then removed from the water tank in the same way as the washing water.

It is desirable to increase the capacity of drum type washing machines to allow washing of larger loads. Washing machines, as with other household appliances, are generally manufactured to a standard size to fit into a standard size space below and between kitchen units. Accordingly, it is desirable that the overall size of the washing machine should remain the same as conventional washing machines. In a conventional washing machine, the size of the cylindrical drum which receives the items to be washed cannot be increased significantly without increasing the size of the water tank in which the drum is provided. The water tank cannot be enlarged without increasing the overall size of the machine, and it is therefore not possible to increase the capacity of a conventional washing machine whilst keeping the overall machine size unchanged.

One solution to this problem is to dispense with the separate water tank and cylindrical rotatable drum, and instead provide a single rotatable drum which both receives the items to be washed and contains all the water for washing and rinsing items. A single drum washing machine is disclosed in U.S. Pat. No. 4,941,333.

A problem with single drum washing machines is that, unlike conventional machines with a fixed water tank, it is difficult to provide heaters, water level detectors and water outlets below the water level in the rotatable water tank, firstly due to the difficulty in making a physical or electrical connection between the fixed body of the machine and the rotating drum, and secondly as a water outlet, heater or detector fixed on a rotating drum will rotate with the drum and hence move above the level of the water as the drum is rotated unless the outlet, heater or detector is provided axially. Even where the outlet is provided axially, the outlet, heater or detector will usually be above the height of the water.

In U.S. Pat. No. 4,941,333, the single drum is provided with an inclined side wall having a larger diameter at the back end than at the open front end. To remove water, the drum is rotated at a high speed forcing water within the drum, by centrifugal force, to the side walls of the drum and, due to the inclined sides, towards the rear of the drum. A fixed wiper blade is mounted on the axle of the drum, which does not rotate, the wiper abutting the rear of the side wall of the drum. As water is forced to the rear of the side wall, the water is wiped from the side wall by the wiper, and runs down the wiper blade to a centrally located outlet.

Such high speed rotation is disadvantageous as water can only be removed when the drum is rotated at high speed, it is not possible to remove water during a wash cycle, and it is therefore not possible to recirculate and reheat the water.

Washing machines are used not only for washing items of clothing, but may also be used for dying of garments. In this case, the washing water is replaced by a suitable dye, but in other respects the washing cycle is unchanged.

SUMMARY OF THE PRESENT INVENTION

According to the present invention, a washing machine comprises a generally cylindrical drum having a substantially closed back end, a front opening, and an inclined axis about which the drum is rotatable, the drum including a plurality of outlets, at least one of which is below the height of the front opening for any angular position of the drum.

With this arrangement, when the water level in the drum reaches the height of the lowest drainage point, the water will flow out of the drum through the outlet. As the lowest outlet is below the height of the front opening, this arrangement helps prevent the water from rising to the level of the front opening, and therefore a door with a water tight seal need not be provided to close the drum. This is particularly beneficial as it is difficult to provide a reliable water tight closure for an opening on a rotating drum for example the open front end of the drum.

Furthermore, as it is not necessary to provide a water tight door, and indeed the front opening may be left open, it is possible to add items to the wash cycle after commencement of the cycle.

Preferably the outlet comprises a plurality of holes arranged on the back face of the drum. In this case, it is advantageous to provide the holes around the circumference of the back face. This ensures that any water on the side of the drum, for example water forced to the side of the drum by centrifugal force during spinning, and water flowing down the side wall of the drum under gravity due to the inclination of the drum, will drain through the holes.

It is preferred that the drum is seated in a fixed collector having a circular or annular recess corresponding to the outlets of the drum. A fixed outlet is provided at the lowermost point of the recess. With this arrangement, water is discharged from the drum into the recess and falls, under gravity, to the outlet from the recess. The water can then be dispensed from the machine or recirculated as required.

Alternatively, the exterior back end of the drum may include a pair of annular walls together defining an annular collector containing each of the water outlets, the annular walls fitting within an annular groove in a fixed housing of the machine, the annular groove having at least one water outlet point. With this arrangement, as the drum is rotated with respect to the housing, the annular walls on the back end of the drum rotate coaxially within the annular groove in the fixed housing. Water dispensed through the outlet or outlets in the back of the drum is contained between the annular walls and within the groove, and is dispensed through the water outlet point in the groove. Accordingly, this arrangement acts as a seal to prevent leakage of water where the outlets are not provided on the axis of the drum, yet allows rotation of the drum, despite the vibrations which occur during rotation.

It is preferred that a splash-proof closure is provided over the front opening of the drum. This prevents water splashing out of the front opening of the drum during the washing and rinsing cycles, and stops items being washed from falling out.

The axis of the rotating drum is preferably inclined at an angle of between 5° and 45°.

The side walls of the drum may be tapered with the circumference near the front of the drum being less than the circumference towards the back of the drum. This ensures that the water in the drum descends towards the collectors due to centrifugal forces, especially at high rotation speeds.

Where the outlets are not provided at the side of the drum, the washing machine also advantageously includes a collector arranged so that, in use, the water contained in the drum is collected and lifted by the collector as the drum rotates and is directed through the or each outlet. This arrangement helps ensure that the water is dispelled from the drum even when the drum is not rotated at a high speed.

In this case, the washing machine preferably includes a plurality of collectors angularly displaced with respect to each other around the back of the drum. This increases the rate at which water can be removed from the drum as with a larger number of collectors, less rotations of the drum are required to remove the water. Where there are a plurality of collectors, an outlet may be associated with each of the collectors.

The or each collector may be arranged to collect water when the drum is rotated in either direction, or arranged so that water is collected only when the drum is rotated in a predetermined direction, either clockwise or anti-clockwise, and water is not collected when the drum is rotated in the other direction. This is advantageous as it allows the drum to rotate, thereby agitating the items within the drum, either with associated dispensing of water, or with retention of water. This may be achieved by providing cup shaped collectors which lift and collect water to the outlet only when the drum is rotated in one direction.

The collectors may be formed as arms extending generally radially on the interior back end of the drum, as buckets mounted on the back of the drum, or deformations formed in the back of the drum.

It is preferred that a divider is provided in front of the outlets and, where provided, the collectors. The divider extends substantially, but not completely, over the back end of the drum. As the divider does not extend over the entire back end of the drum, water can still pass through the divider to be discharged from the drum, however items being washed cannot pass through the divider and become entangled in the outlets or on the or each collector. The divider is preferably formed with apertures provided around the circumference which abuts the side walls of the drum through which the water can pass, or can be formed with perforations through which the water can pass.

The washing machine may include a pair of raised projections, each projection extending substantially from the back of the drum to the front of the drum, one of the projections extending generally clockwise from the rear of the drum to the front of the drum, and the other extending generally anti-clockwise from the rear of the drum to the front of the drum, so that in use, items provided within the drum are lifted and drawn towards the front of the drum by rotation of the drum in either direction.

It is generally known to provide raised projections, or "agitators" within the drum of a washing machine so that rotation of the drum lifts the items to be washed through the water within the drum. With this arrangement, the pair of projections, which may be straight or curved, one extending in a clockwise direction and the other in an anticlockwise direction, both lifts and draws forward the items when the drum is rotating in either direction, one of the projections drawing the items forward in either direction of rotation. This provides better agitation than prior art systems in which straight agitators merely lift the items circumferentially around the drum.

It is preferred that a plurality of projections are provided extending in both clockwise and anti-clockwise directions to improve the agitation of the garments further. The projections preferably extend in a generally helical direction around the inner circumference of the rotating drum.

The washing machine preferably includes a heater for heating water added to the drum and rotatable with the drum. Preferably the heater is provided in a recirculation path between the water outlet and the water inlet. In this way, during the normal wash cycle water can be removed from the drum through the water outlets, reheated and resupplied to the drum through the inlet thereby maintaining the water at a constant temperature.

The washing machine may include a perforated container provided within the rotating drum and closely abutting the inner surface of the drum. In this way, the items to be washed can be placed in the perforated container, and after completion of the washing cycle the perforated container can be removed from the drum together with all the washed items. As the perforated container closely fits the side walls of the drum, the capacity of the washing machine is not reduced significantly by the provision of the perforated container. The use of a perforated container allows for easy unloading of the drum.

Where collectors or agitators are provided, these may be provided within the perforated container rather than, or in addition to, being provided in the drum itself.

Advantageously, the washing machine includes a water level detector to determine the volume of water in the drum. Where the washing machine includes a recirculation path along which expelled water is returned to the rotatable drum, the recirculation path may include a chamber open to the atmosphere, a pressure sensor downstream of or below the water surface in the chamber and a means for determining the volume of free water in the rotatable drum from the pressure.

When water is introduced into the drum, the water will initially be absorbed by the clothes. When the clothes are saturated, additional water added to the drum will remain "free" within the drum. It is desirable to saturate the clothes, and have a predetermined free volume of water within the drum. In accordance with the preferred feature of the invention, the amount of water can be determined, and therefore water can be supplied to the machine to saturate the clothes and give a predetermined volume of free water irrespective of the amount of absorbed water by cutting off the supply when the predetermined volume of free water is detected.

The water expelled from the rotatable drum is introduced to the open chamber from which the recirculation path returns to the rotatable drum. As the chamber is open, it is at atmospheric pressure, and so the detected pressure is not affected by pressure fluctuations which may occur in a closed system. The volume of water can be calculated from the detected pressure.

The recirculation path advantageously includes a pump to recirculate the water, and may include a heater to reheat the water to a required temperature.

In all aspects of the present invention, it will be understood that the machine may be used for purposes other than washing items, for example for dying items, in which case the washing water is replaced by a suitable dye.

DETAILED DESCRIPTION OF PREFERRED EXAMPLES

Figure 1:
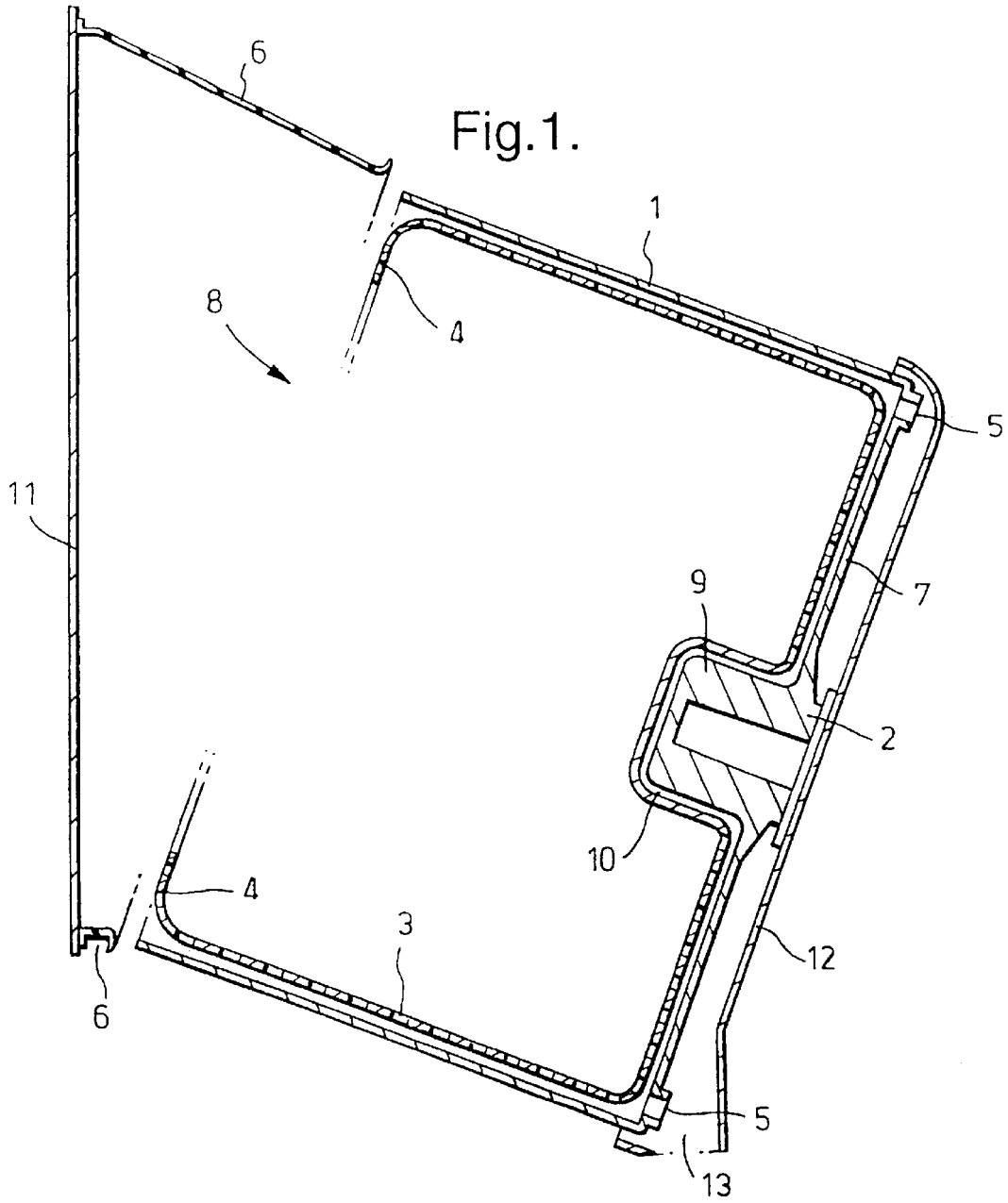
FIG. 1 shows a cross-section through an example of a washing machine according to the present invention.

FIG. 1 shows a cross-sectional view taken through the axis of a generally cylindrical drum of a washing machine according to the present invention. The cylindrical drum includes side walls 1 and a circular back end wall 7 defining a drum with an open front 8. The drum is mounted on an axial spindle 2 for rotation about its axis which is inclined to the horizontal at an angle of about 20°. The back surface 7 of the drum includes a plurality of outlet holes 5. The lowest outlet hole 5 at any angular position of the drum is below the vertical height of the lowest part of the lip defining of the front opening 8.

The drum also includes a removable perforated container 3 which is positionable within the drum through the front opening 8 of the drum, and which is removable through the front opening 8. The perforated container 3 is shaped and dimensioned to correspond closely to the internal walls of the drum so the internal volume of the perforated container 3 is only slightly smaller than that of the drum. The perforated container 3 is generally tapered so that the front end including the opening has a larger diameter than the rear closed end. This assists in the insertion of the perforated container 3 into the drum. The perforated container 3 has perforations through which water in the drum can pass into the perforated container 3, and through which water in the perforated container 3 can drain into the drum. The perforated container 3 is held within the drum in such a way that the perforated container 3 rotates with the drum. This is achieved by a projection 9 provided on the drum which engages with a recess 10 on the perforated container 3. Where the projection 9 and recess 10 are provided axially, the projection 9 and recess 10 have a non-circular shape to transmit the rotation of the drum to the perforated container 3. The projection 9 and recess 10 may be provided non-axially, and in this case the projection 9 and recess 10 can have any desired shape. Alternatively, the projection may be provided on the perforated container 3 and the recess on the drum, or, where there is more than one projection and recess, a mixture of recesses and projections may be provided on both the drum and the perforated container 3.

The open end of the perforated container 3 includes an annular ring 4 giving a reduced diameter opening to the perforated container 3. The ring 4 ensures that clothes do not fall out of the perforated container 3 during the washing cycle.

Figure 2:
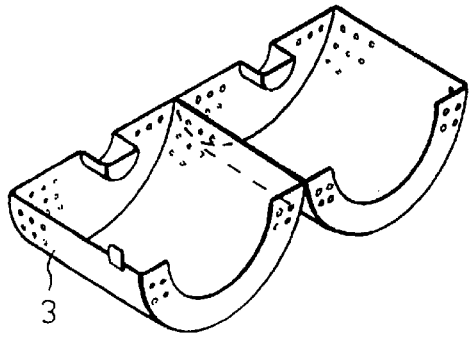
FIG. 2 shows a perforated container.

As shown in FIG. 2, in one example the perforated container 3 includes a hinged portion extending along the side of the perforated container 3 generally parallel to the longitudinal axis of the perforated container 3. The perforated container 3 also includes a clasp to hold the perforated container 3 in its generally cylindrical shape. In this way, a clasp may be undone and the perforated container opened about the hinge to allow easy access to the contents of the perforated container.

Figure 3:
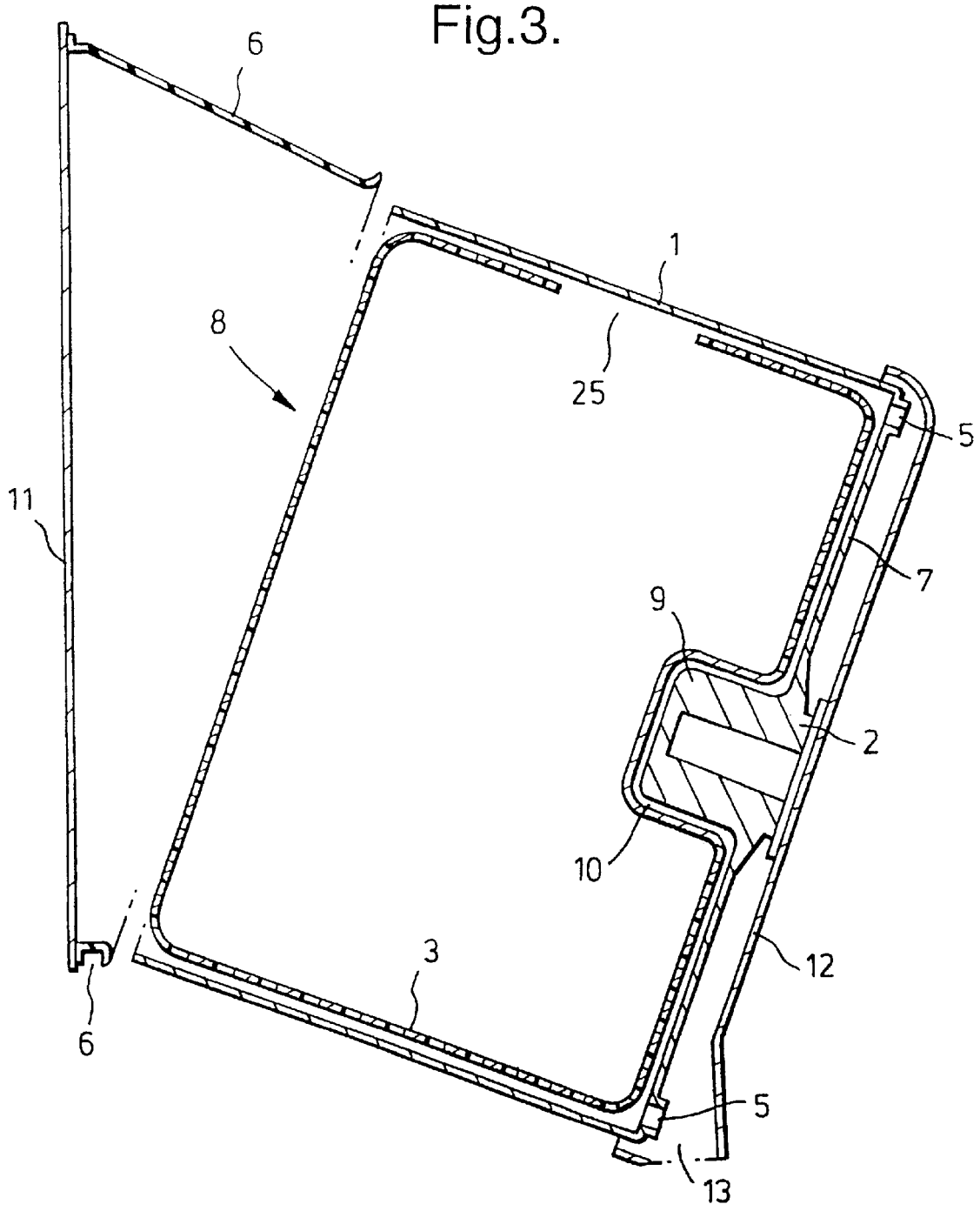
FIG. 3 shows an alternative perforated container provided in the machine of FIG. 1.

An alternative example of a perforated container is shown, in a drum, in FIG. 3. The perforated container includes a completely closed front end, and an opening 25 in the side wall. As the side wall corresponds closely with the inside of the drum, items contained within the perforated container are not able to fall from the perforated container through the opening into the drum. With this arrangement, items to be washed are added to the perforated container through the opening 25 before the perforated container is placed in the drum. When full, the perforated container is lifted into the drum, effectively closing the perforated container so all the items to be washed are maintained within the perforated container. With this arrangement, it is not possible to add items after the washing cycle has begun.

A shroud 6, inclined to the horizontal at the same angle as the drum is provided to a vertical front opening of the machine. The opening of the machine is closed by a door 11. This closure does not form a watertight seal but acts merely to prevent splashes during the washing cycle.

In use, clothes are placed into the perforated container 3, either before the filled perforated container 3 is put in the cylindrical drum through the front opening 8, or when the perforated container 3 has been positioned in the drum. Water, which may include washing detergent is introduced to the drum through the spindle 2. The water enters the perforated container 3 through the perforations in the perforated container to wet the clothes.

As the lowermost outlet 5 is below the height of the lip of the open front end 8 irrespective of the angular position of the drum, and due to the inclination of the drum, water entering the drum can rise to the level of the lowermost outlet 5, the lowest drainage point, and any additional water will drain through the lowermost outlet 5. As the lowest drainage point is below the level of the lip of the open front end 8, and providing the outlets 5 are of a suitable size the water level will not rise to that of the lip of the open front end 8.

When the water and clothes are in the perforated container 3 within the cylindrical drum, the drum is rotated about its inclined axis, thereby agitating the clothes in the water to wash them.

The rear 7 of the drum is positioned within a recess of a water collector 12 which is fixed on the suspension of the machine. As water is discharged through the holes 5 in the back of the drum, this will be collected in the water collector 12, and will fall, under gravity, to the bottom of the water collector to be dispensed through the outlet 13. The rate at which the water is discharged from the drum is such that there is no need to provide a hermatic seal between the edge of the water collector 12 and the outside of the drum.

During the washing cycle, the water may be recirculated, and may pass through a heater (not shown) to reheat the water, before being reintroduced to the drum through the inlet 2. This ensures that the water within the drum is maintained at the required temperature. When it is desired to dispense the water, the water from the outlet 13 is not recirculated, but is merely dispensed down a drain.

Figure 4:
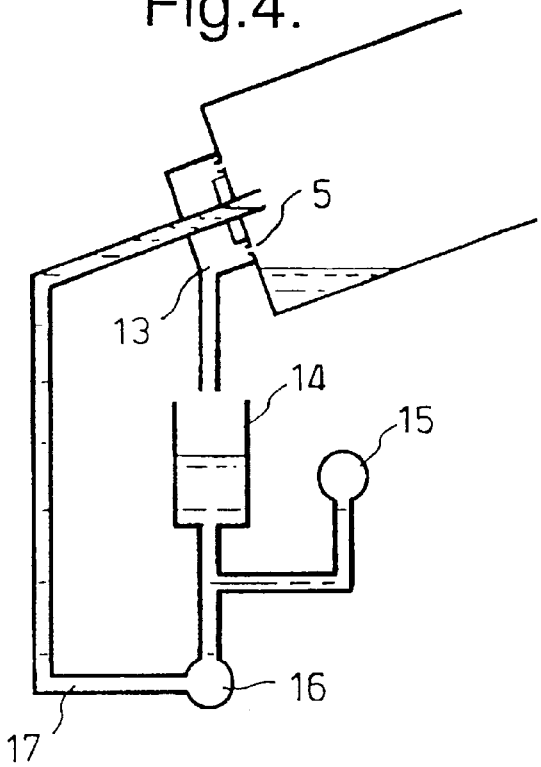
FIG. 4 shows a water volume determination system.

FIG. 4 shows a schematic view of a water volume detector which is provided in the recirculation path to determine the volume of the free water in the drum. In a fixed-tank recycling washing machine, the volume of water in the tank can be determined by measuring the pressure difference in part of the recycling circuit. The water in the fixed tank is pumped from the tank, around a recycling path and back into the fixed tank. A pressure sensor provided between the tank and the pump detects the pressure due to the head of water in the tank, and from this the volume of water can be calculated from the measured pressure. The pressure in the drum is at atmospheric pressure as the drum is not perfectly sealed. Where the water tank is a rotating drum, this system cannot be used unless the outlet is provided at a fixed point below the surface of the water. As previously described this is difficult.

According to the present example, a system is provided to ensure that sufficient water is added to the drum to saturate the items to be washed completely. Water from an external source is added to a secondary chamber 14 which is open to the atmosphere. The water is pumped from the secondary chamber 14 into the main drum. Water discharged from the drum is introduced into the secondary chamber 14. A pressure detector 15 is provided between the secondary chamber 14 and the pump 16, and by measuring the pressure it is possible to determine the volume of water in the chamber 14. The secondary chamber 14 is open to the atmosphere, so the detected pressure is purely due to the head of water in the secondary chamber 14. If the secondary chamber 14 were closed, the pressure in the tank may vary as the volume of water compresses the air in the tank.

Initially, the water entering the secondary chamber 14 from the external source is pumped into the drum and is absorbed by items in the drum. No or little water will be discharged from the drum. When the items in the drum are completely saturated, additional water will be discharged from the drum into the secondary chamber 14. This additional water will change the rate of change of the volume of water in the secondary chamber 14, or the water in the secondary chamber will reach a predetermined volume. This is detected by the pressure sensor. When it is determined that sufficient water has been provided to the drum, the external supply can be cut off.

Figure 5:
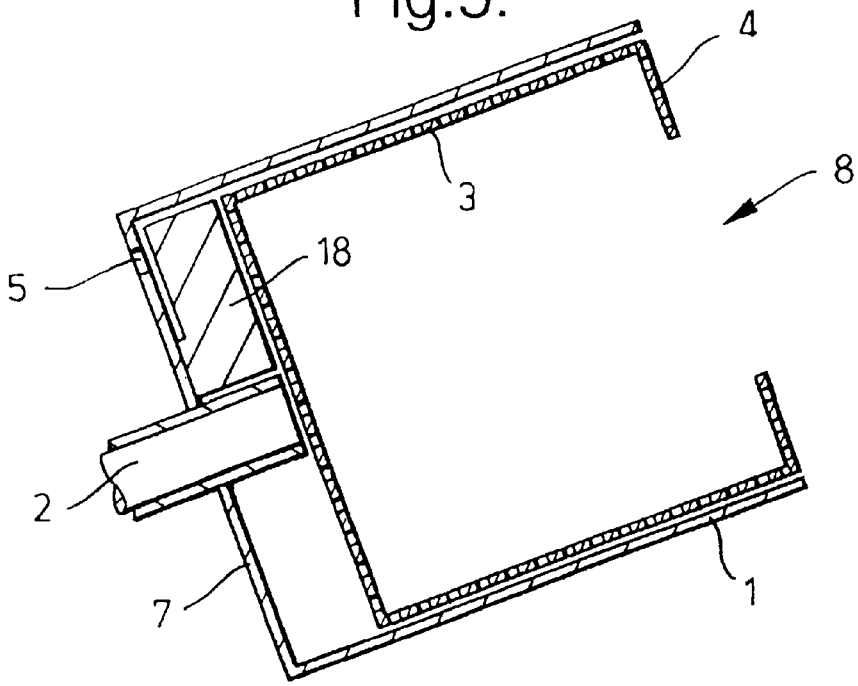
FIG. 5 shows a cross-sectional view through an alternative example of a washing machine drum.
Figure 6:
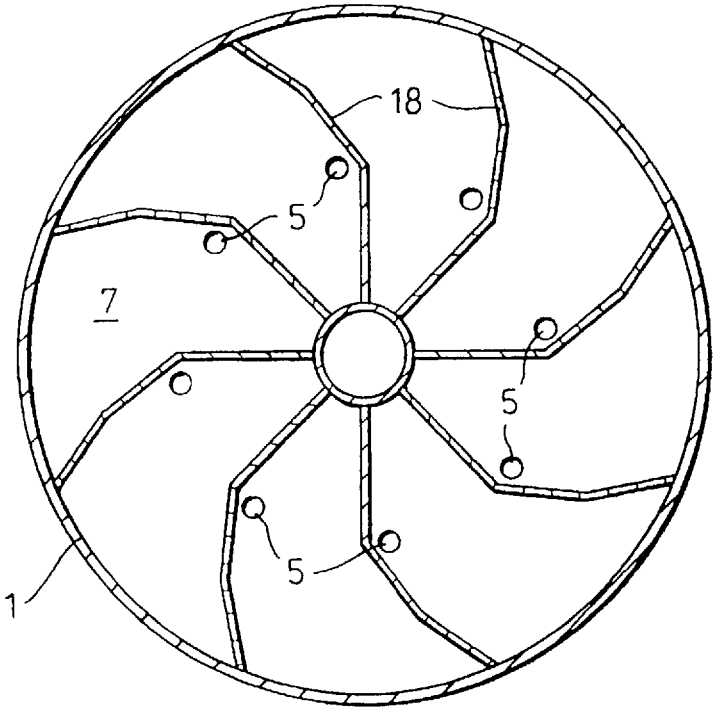
FIG. 6 shows an axial view of the washing machine drum of FIG. 5.

An alternative example of the present invention is shown in FIG. 5. In this case, collectors 18 are provided at the back of the drum. These collectors 18 are best seen in the axial view of FIG. 6, in which the perforated container has been removed for clarity. In this case, the collectors 18 are provided in the form of arms on the rear surface 7 of the drum. Due to the inclination of the drum, the water in the drum will fall, under gravity, to the back of the drum. Anti-clockwise rotation of the drum, when viewed from the front end 8, causes this water to be scooped up by the collectors 18. The continuing rotation of the drum causes the arms 18 to lift the water collected, and directs the collected lifted water through the outlet holes 5. Accordingly, by continually rotating the drum in an anti-clockwise direction, the water within the drum is expelled through the back 7 of the drum through the holes 5.

Where the drum rotates in a clockwise direction, the water will not be collected by the arms 18 due to their curved shape and therefore the water will generally remain within the drum, however some will be discharged where the water level is above the height of the outlets 5.

Figure 7:
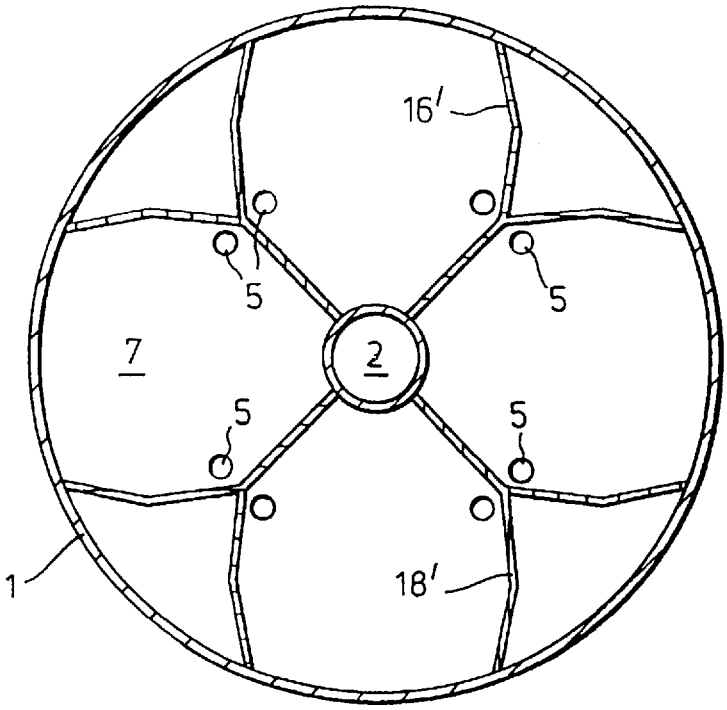
FIG. 7 shows an axial view of an alternative washing drum.

FIG. 7 shows a further alternative arrangement in which the arms 18' are shaped so that water is collect and expelled when the drum rotates in either direction.

Figure 8A:
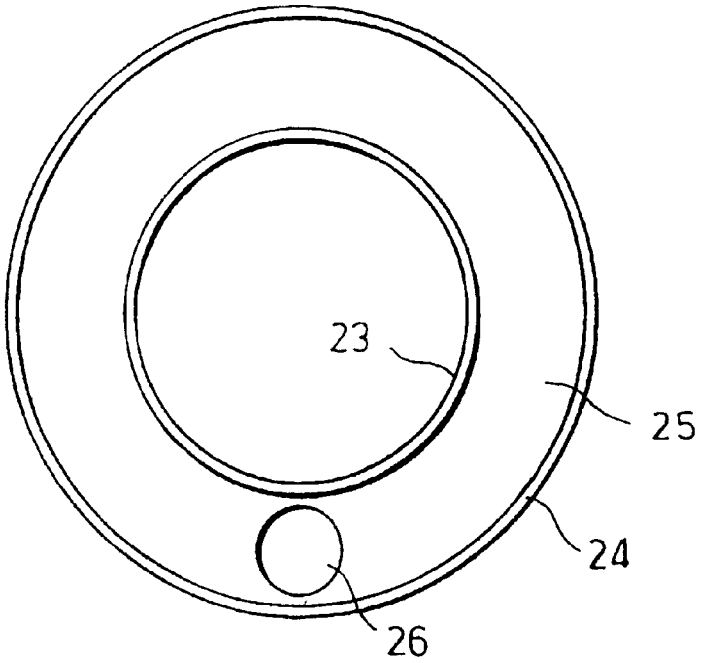
FIGS. 8*a* and 8*b* show an alternative water outlet arrangement.
Figure 8B:
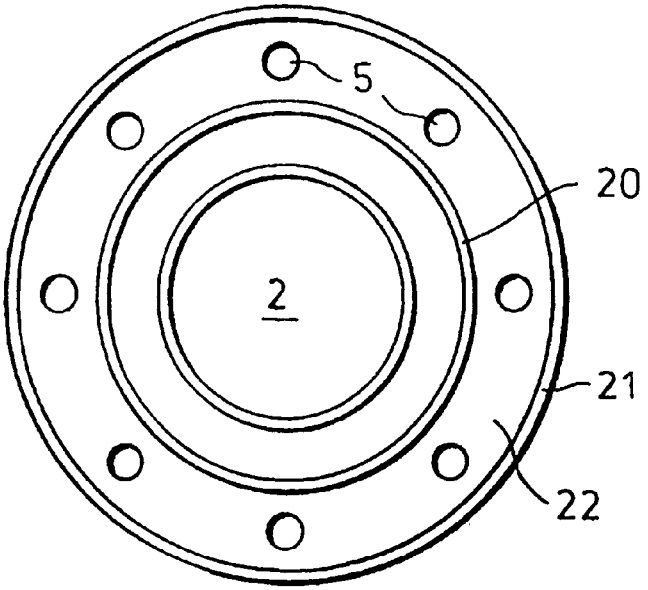

Rather than the recessed water collector 12, other systems can be provided to collect the water discharged through the rotating back end of the drum. As shown in FIG. 8*b,* the rear of the drum 7 may be provided with two annular rings 20 and 21 defining a channel 22 containing the outlet orifices 5. As shown in FIG. 8*a,* the housing of the washing machine similarly includes two annular walls 23, 24 to define a groove 25, the width of the groove 25 being such that the walls 20 and 21 on the back of the drum 7 are provided within the groove 25. The groove 25 includes a single outlet 26, although additional outlets may be provided. With this arrangement, the drum is free to rotate, yet as water is dispensed through the dispensing orifices 5 it is constrained by the grooves 22 and 25 and directed to the single fixed outlet 26.

Figure 9:
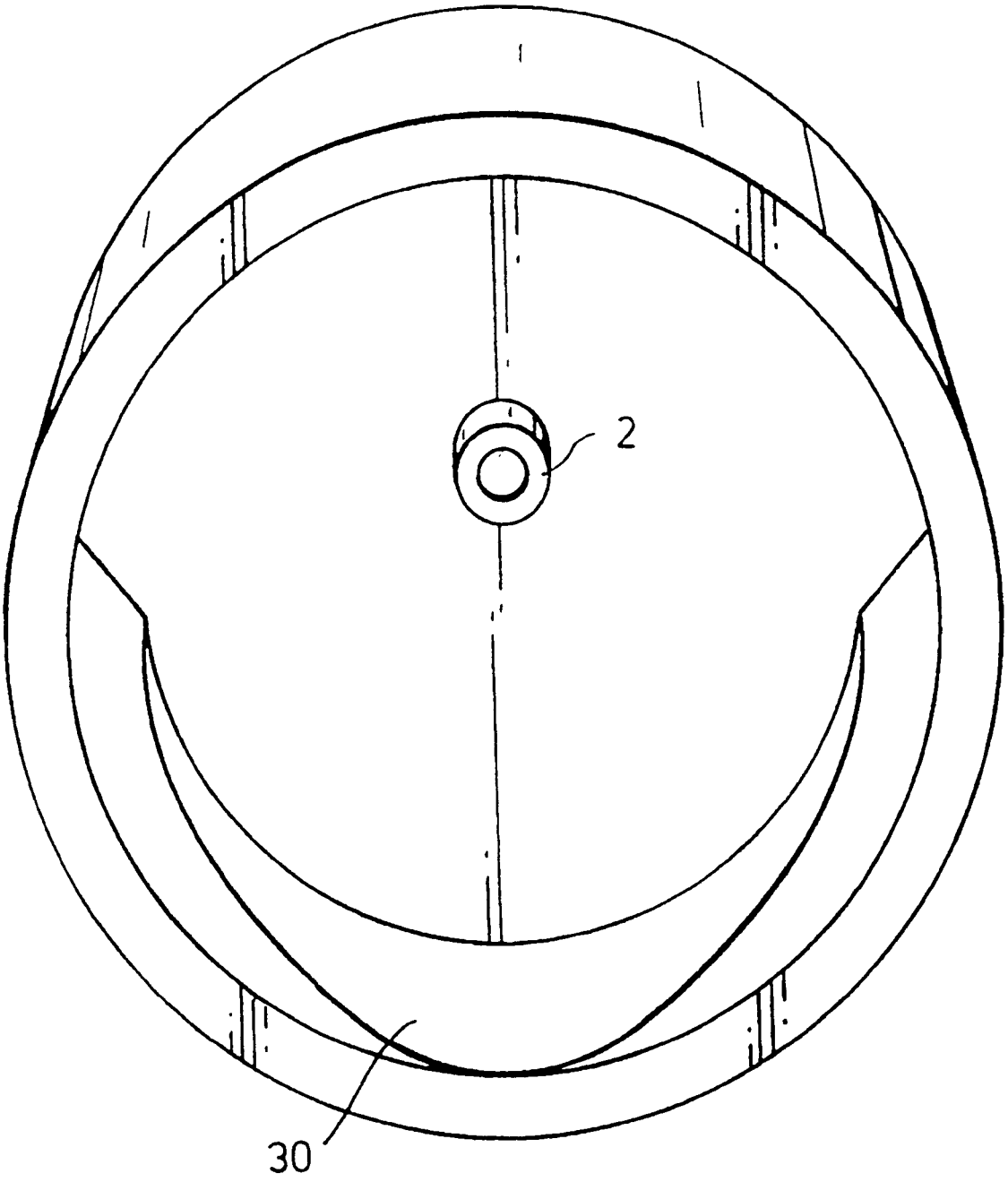
FIG. 9 shows agitators.

The drum or perforated container 3 may be provided with agitators to lift the clothes within the drum. As shown in FIG. 9 agitators are in the form of a projection 30 which extends from the back of the drum 7 circumferentially around the drum and towards the front of the drum and returns to the back of the drum.

The base of the agitator 30 is generally triangular in cross-section, having a maximum height from the side walls 1 near the base 7 of the drum, and a minimum height near the front 8 of the drum. The cross-sectional shape of the agitator 30 may be other than triangular. The agitator 30 has rounded apexes to prevent damage to the clothes. Where the agitators are provided on the inside of the drum, the perforated container 3 is provided with corresponding agitators. In this case the agitators act to hold the perforated container within the drum to prevent relative rotational movement of the drum and perforated container 3 during the washing cycle. Although only one agitator 30 is shown, two or more agitators may be included.

Because the agitator 30 includes components extending towards the front of the drum in both a clockwise and anti-clockwise circumferential direction, on rotation of the drum, articles within the drum are lifted and drawn towards the front of the drum upon rotation of the drum in either direction.

What is claimed is:

1. A washing machine comprising a generally cylindrical drum having a substantially closed back face, a front opening, and an axis inclined to the horizontal about which the drum is rotatable, wherein the drum includes a plurality of outlets provided on the back face of the drum generally around an outer circumference of the back face, at least one of which outlets is below the height of the front opening for any angular position of the drum.

2. A washing machine according to claim 1, in which the outlets comprise a plurality of holes.

3. A washing machine according to claim 1, in which the drum is seated in a fixed collector having a circular or annular recess corresponding to the outlets of the drum and a fixed outlet at the lowermost point of the recess.

4. A washing machine according to claim 3, further comprising a perforated container positioned within the drum and closely abutting an inner surface of the drum.

5. A washing machine according to claim 1, further comprising a fixed housing, an exterior of the back face of the drum including a pair of annular walls together defining an annular trough containing said outlets, the annular walls fitting within an annular groove defined by annular walls in the fixed housing, the annular groove having at least one water outlet port.

6. A washing machine according to claim 1, in which the axis of the rotating drum is inclined at an angle between about 5° and about 45° to the horizontal.

7. A washing machine according to claim 1, in which the drum further comprises side walls extending between the back face and a front end, the side walls being tapered with a circumference near the front end being less than a circumference toward the back face of the drum.

8. A washing machine according to claim 1, further comprising a perforated container positioned within the drum and closely abutting an inner surface of the drum.

9. A washing machine according to claim 1, further comprising a water level detector to determine the volume of water in the drum.

10. A washing machine comprising a generally cylindrical drum and a fixed collector; the drum having a substantially closed back face, a front opening and an axis inclined to the horizontal about which the drum is rotatable, wherein the drum includes a plurality of outlets provided generally around an outer circumference of the back face, at least one of which outlets is below the height of the front opening for any angular position of the drum with respect to the fixed collector; the fixed collector having a circular or annular recess corresponding to the outlets of the drum and a fixed outlet in fluid communication with the recess for draining fluid therefrom.

11. A washing machine according to claim 10, in which the outlets comprise a plurality of holes.

12. A washing machine according to claim 10, further comprising a perforated container positioned within the drum and closely abutting the inner surface of the drum.

* * * * *